United States Patent [19]

Fehlmann

[11] Patent Number: 4,462,949

[45] Date of Patent: Jul. 31, 1984

[54] BATTERY-MOLDING METHOD AND MOLDING APPARATUS

[76] Inventor: Hans B. Fehlmann, Seestrasse 160, CH-8700 Küsnacht, Switzerland

[21] Appl. No.: 335,093

[22] Filed: Dec. 28, 1981

[30] Foreign Application Priority Data

Dec. 30, 1980 [CH] Switzerland ..... 9631/80
Aug. 24, 1981 [CH] Switzerland ..... 5426/81

[51] Int. Cl.[3] ..... B28B 7/08; B28B 21/56

[52] U.S. Cl. ..... 264/261; 249/26; 249/33; 249/40; 249/83; 249/137; 264/263; 264/273; 264/274; 264/277; 264/310; 264/333

[58] Field of Search ..... 249/83, 84, 85, 33, 249/137, 26, 40; 425/436 RM, DIG. 122, 241, 435, 439; 254/93 HP; 264/253, 256, 261, 263, 273, 277, 310, 333, 274

[56] References Cited

U.S. PATENT DOCUMENTS

| | | | |
|---|---|---|---|
| 1,159,184 | 11/1915 | Dale | 249/33 |
| 1,326,246 | 12/1919 | Young | 249/83 |
| 2,831,232 | 4/1958 | Lawson | 249/83 |
| 2,964,821 | 12/1960 | Meehan | 264/256 |
| 3,008,551 | 11/1961 | Cole . | |
| 3,664,630 | 5/1972 | Maynen et al. | 249/33 |
| 4,139,670 | 2/1979 | Fehlmann | 428/167 |

FOREIGN PATENT DOCUMENTS

| | | | |
|---|---|---|---|
| 1220966 | 1/1971 | United Kingdom | 254/93 HP |
| 2052637 | 1/1981 | United Kingdom | 254/93 HP |

OTHER PUBLICATIONS

"New For Industry", *Science Digest,* Feb. 1974, p. 56.

*Primary Examiner*—James B. Lowe
*Attorney, Agent, or Firm*—Werner W. Kleeman

[57] ABSTRACT

The method of battery molding metal-reinforced panels of matrix forming materials like, for example, concrete is improved by the use, as reinforcement for each panel, of a stratiform and biplanar structure formed of two spaced coextensive metal sheets in a parallel and mutually supporting arrangement. Preferably, at least one sheet has a multiplicity of perforations as well as a multiplicity of protrusions. The reinforcements are provided with partitioning layers and stacked in the cavity of a molding box. Upon casting and setting of the concrete or the like material into the cavity compartments metal-reinforced panels are obtained in which the biplanar reinforcement extends substantially through the panel. The tiltable molding apparatus for use in battery-molding of the panels includes a molding box in combination with at least one fluid-cushion or fluid-bag capable of varying its outer shape in response to the amount of fluid within said cushion. The cushion rests on a support surface, such as the ground of a construction site, and is connected in a force-transmitting relation with an exterior portion of the molding box in a manner to cause tilting of the molding box by variation of the amount of fluid within the cushion.

17 Claims, 13 Drawing Figures

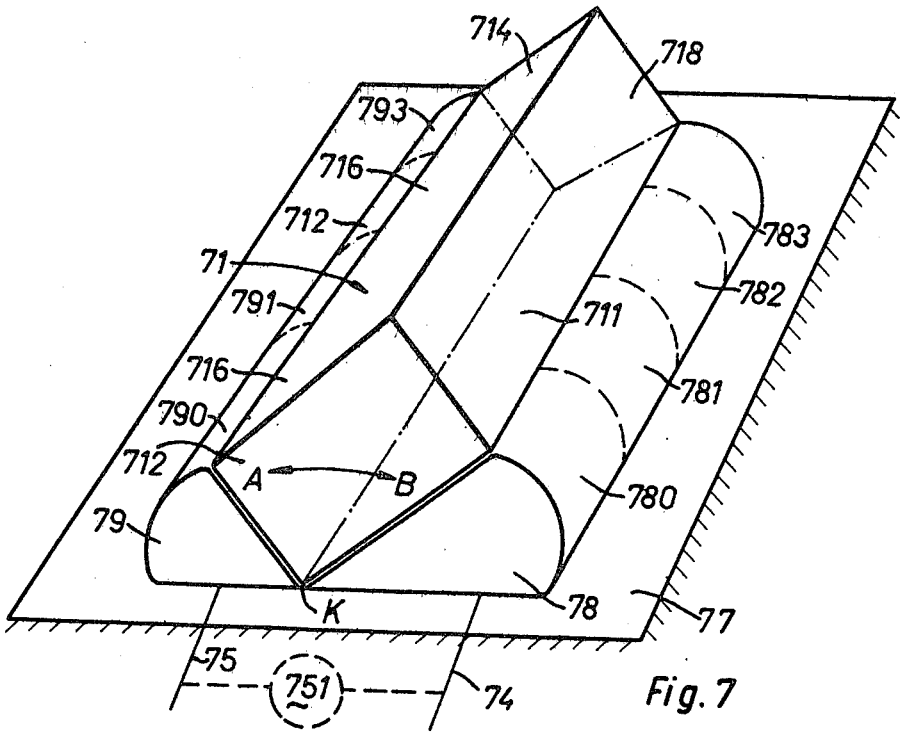
Fig. 7
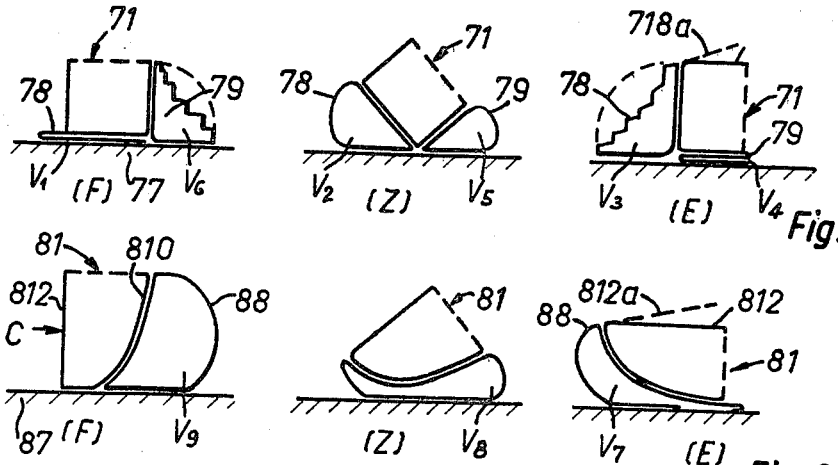
Fig. 7A
Fig. 8

BATTERY-MOLDING METHOD AND MOLDING APPARATUS

BACKGROUND OF THE INVENTION

1. Field of the Invention

This invention generally relates to the production of construction elements and specifically to a method of cast-molding a plurality of metal-reinforced panels of concrete or the like pourable and hardenable matrix-forming material in a molding box, as well as to an improved molding apparatus suitable for use in producing metal-reinforced panels and other types of concrete or the like based construction elements.

2. Prior Art

Molding methods and devices for producing, in a single batch, a plurality of metal-reinforced structural elements by casting a flowable and hardenable material, such as concrete, a plaster mix or the like, into a partitioned molding box (also called a molding battery) are well known in the art, cf. for example U.S. Pat. Nos. 1,430,763, 2,560,781 and 3,542,329, Belgian Pat. No. 564,974, French Pat. No. 1,095,530 and German published patent application No. 2,907,969. Such prior art molding methods and devices have the common disadvantage that partitioning means in the form of molding boards are required and that lateral guidance of the boards by wall portions of the molding cavity is mandatory for producing panels of a predetermined and uniform thickness; in this context, "lateral guidance" means the support required to keep the partitioning means in a defined position within the molding cavity. For example, a molding board that substantially matches the interior surface of the side walls of the cavity and rests on the mold bottom has no lateral guidance in the cavity unless mechanical means, such as ribs, grooves, pins or the like, are provided on the cavity walls for maintaining the boards in their predetermined (i.e. defining the panel thickness) position prior to introducing the reinforcing elements and the matrix-forming material.

Further, prior art methods require substantially rigid and correspondingly heavy partitioning means, and operational problems result because both the lateral guidance and the molding boards in the molding box as well as the molding boards themselves tend to become damaged in prolonged operation.

A further problem of prior art battery-molding methods for producing metal-reinforced concrete panels is due to disadvantages of conventional metal-reinforcements that neither can be easily brought into tne molding compartments, nor simply maintained in proper position therein.

Finally, withdrawal of the panels produced by battery-molding may be very cumbersome unless the molding box is tiltable, as is known per se, between a casting position and a discharge position, e.g. by about 90°, around a longitudinal axis of the box. With a charge having a weight in the order of magnitude of hundred metric tons or more this requires heavy construction of prior art molding apparatus, both for the molding box as well as for the associated tilting mechanism.

OBJECTS AND SUMMARY OF THE INVENTION

Accordingly, a main object of the invention is the provision of a novel and improved battery-molding method for producing metal-reinforced panels of concrete and the like matrix-forming materials.

A further object is to improve production of metal-reinforced panels by battery-molding methods where lateral guidance of the partitioning means by the molding box is not required and wherein the use of rigid and heavy partitioning means is not critical.

Another object of the invention is to provide for panel production by battery-molding wherein the metal-reinforcements of the panels have a stratiform and generally rigid structure suitable for maintaining well defined molding compartments prior to casting, thus permitting the use of laterally unguided partitioning means that need not be rigid.

A further object is the provision of a battery-molding method wherein positional definition of the mold compartments prior to casting is effected by the metal-reinforcements of the panels and wherein the reinforcements of the panels can be improved.

Yet another object of the invention is the provision of a novel tiltable molding apparatus that requires neither a heavy construction of the molding box proper nor of the tilting means.

Still a further object of the invention is the provision of a tiltable molding apparatus that can be transported more easily and may be assembled and disassembled at a construction site in a simple manner as well as adapted to varying panel dimensions so as to provide for decreased molding costs when producing metal-reinforced panels.

According to the invention it has been found that the metal-reinforcement elements conventionally used in battery-molding of panels of concrete or the like materials do not have sufficient shape definition or shape congruence, i.e. are neither sufficiently conformed with, nor sufficiently conformable to, the general shape of the final panels.

Further, it was found that shape definition in a generally self-supporting reinforcement structure and sufficient rigidity of that structure are required for generally improving the economic feasibility of producing metal-reinforced panels by battery-molding methods.

Now, it was found according to a first general embodiment of the invention that the above objects relating to the metal-reinforcement of panels produced by battery-molding will be achieved by using, as metal-reinforcing elements, generally stratiform biplanar structures formed of at least two distanced metal sheets maintained in a substantially parallel and mutually supporting arrangement; generally, each such structure will extend substantially through each panel. While the use of metal sheets maintained in substantially parallel and mutually supporting distanced relation (also termed "sheet pairs" herein) as metal-reinforcements is essential to the invention, permanent interconnection of the sheet pairs prior to casting is not.

According to a second general embodiment of the invention it was found that the above objects relating to tilting of battery molds will be achieved by using so-called fluid-cushions, i.e. at least one bag or the like deformable and flexible structure capable of varying their outer shape in response to a variation of the amount of fluid contained therein; the cushion or bag rests on a support surface, such as the ground of a construction site, and is connected with the molding box in a manner causing a tilting movement of the molding box when the amount of fluid within the cushion, or cushions, is changed in a predetermined manner.

PREFERRED EMBODIMENTS OF THE INVENTION

According to a first preferred embodiment of the inventive method, at least one of the metal sheets of the biplanar sheet pair structure is perforated and comprises a multiplicity of protrusions of substantially uniform height extending from a first or base plane defined by the unperforated sheet portions to a second or elevated plane distanced from but essentially parallel with the first plane.

In this embodiment, the second metal sheet of the biplanar structure may be a substantially coextensive plain metal sheet that abuts upon the protrusions of the other sheet.

According to a second preferred embodiment of the inventive method, the biplanar reinforcement is formed of two perforated metal sheets having protrusions as just mentioned and arranged in such manner that the protrusions of each one sheet abut upon the base plane of each second sheet.

Various types of metal sheets having protrusions suitable for the inventive method are known in the art of metal composites, e.g. as disclosed in French Pat. No. 1,045,315 and in U.S. Pat. No. 3,008,551; a particularly preferred type of metal sheet for use in the present invention is disclosed in U.S. Pat. No. 4,139,670 incorporated herein by way of reference.

In battery-molding according to all embodiments of the inventive method, the biplanar reinforcements are arranged in the cavity of the molding box as a stack with partitioning means or layers between any adjacent pairs; because of the mutually supporting arrangement of the metal sheet in the sheet pairs the reinforcements are substantially rigid and substantially incompressible so that partitiononing means or layers can be formed simply by applying a layer of mold-release agent, such as mineral oil, onto the outer surface of the sheet pairs. Other types of partitioning means can be used as well as explained below.

Generally, the layers of the stack in the cavity of the molding box are parallel to the side walls of the molding box and have essentially the same length as the cavity. Then, a flowable and hardenable material, such as a pourable concrete mix or the like matrixing material, is cast into the partitioned molding cavity until the reinforcements are covered, and the matrixing material is allowed to harden. Casting and hardening of the concrete or the like material is effected with the stack in a vertically layered orientation and the bottom of the molding box in horizontal position. When using a tiltable molding box, formation of the stack prior to casting as well as discharging the panels after hardening of the concrete may be done when the bottom wall of the molding box is not horizontal, e.g. in a vertical or inclined position.

Thus, while casting requires vertical stratification of the stack, both the stacking and the discharge operation may be done advantageously with a non-vertical, e.g. horizontal, stratification of the stack. Accordingly, use of a tiltable molding box is advantageous for the inventive method and the use of the novel tiltable molding apparatus disclosed herein is preferred.

Suitable matrixing materials and casting methods are known in the art and will not be discussed herein in detail.

Typical panels that can be obtained according to the invention comprise the biplanar metal-reinforcement and a matrix of concrete or the like material shaped in substantial shape congruence with the external form of the biplanar reinforcement. A typical panel thickness is in the range of from 20 mm to 300 mm or more; a typical panel length is in the range of from 1 m to 20 m while a typical panel width is in the range of from 0.5 m to 3 m or more.

The term "metal sheet" is intended to encompass sheets or plates made of normally solid structural metals such as iron, iron alloys including steel (preferred), aluminum or the like with a typical gauge of from about 0.2 mm to about 5 mm, preferably of from about 0.5 mm to about 3 mm.

"Protrusion" is intended to encompass elements of a predetermined shape extending from a metal sheet, e.g. local deformations of the metal sheet; integral protrusions of the type obtained by controlled local deformation of a sheet, such as by deep-drawing, generally combined with slit-cutting for controlled shaping in subsequent deep-drawing, are preferred.

"Battery-molding" refers to the method of casting into a multi-partitioned molding cavity a flowable or pourable and hardenable material capable of forming a matrix that is capable to encompass a metal-reinforcement; typical examples are concrete mixtures of the light, medium or heavy type, but other mineral-based or polymer-based matrixing materials are not excluded.

The term "shape congruence" as used herein refers to a substantial similarity or congruity of the general outer shape of one body with another and does not imply congruence in the mathematical or geometrical sense.

"Rigid" with regard to the biplanar reinforcement is meant to indicate the capacity of the reinforcement structure to maintain its biplanar stratiform shape without substantial deformation under loads acting upon the reinforcement structure in the molding box during casting including laterally acting pressures caused by vertical or horizontal stacking of the reinforcement structures.

"Partitioning means" refers to layers between adjacent biplanar reinforcing structures suitable to partition, i.e. maintain separate or separable, the stacked reinforcement structures in the casting operation; thus, partitioning means includes separate means, such as molding boards, preformed layers or panels that are attached to the reinforcing structures or become attached to the latter upon casting, polymer sheets or layers, and films of a mold-release agent, such as a mineral oil, applied to the outer surface of a biplanar reinforcing structure.

Generally, partitioning layers, such as a coating of permanent or temporary mold-release material, can be applied to the mold cavity walls.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 7 is a diagrammatic perspective view of a tiltable molding apparatus according to the invention;

FIG. 7A is a diagrammatic presentation of tilting positions of the apparatus of FIG. 7, and FIG. 8 is a diagrammatic presentation of the operating positions of a second embodiment of the inventive apparatus.

DETAILED DESCRIPTION OF THE PREFERRED EMBODIMENT

Figure 1A:
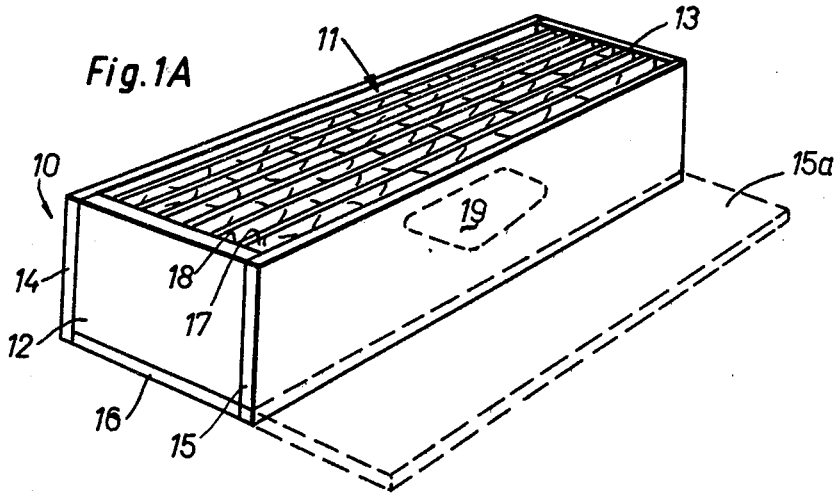
FIG. 1A is a perspective view of the general scheme of a molding box containing a stack of biplanar structures for producing panels according to the invention.

The general diagram of a molding box 10 for use in the inventive method is shown in FIG. 1A. Box 10 essentially consists of two front walls 12, 13, two side walls 14, 15 and a bottom wall 16. The interior surfaces of the wall members define an elongated mold cavity.

A vertically layered stack 11 of biplanar structures 17, 18 with partitioning layers inbetween is arranged within the cavity of box 10. The length of each structure 17, 18 is substantially the same as that of the cavity and the partitioning layers are generally coextensive with the biplanar structures 17, 18.

Preferably, box 10 is tiltable as explained below and permits opening of the cavity, e.g. by removing or releasing one side wall 15 as shown in broken lines in released position 15*a*.

Box 10 with stack 11 is in casting position, i.e. prior to filling concrete or the like material into the mold compartments defined essentially by the biplanar structures 17, 18 between partitioning layers.

Figure 1B:
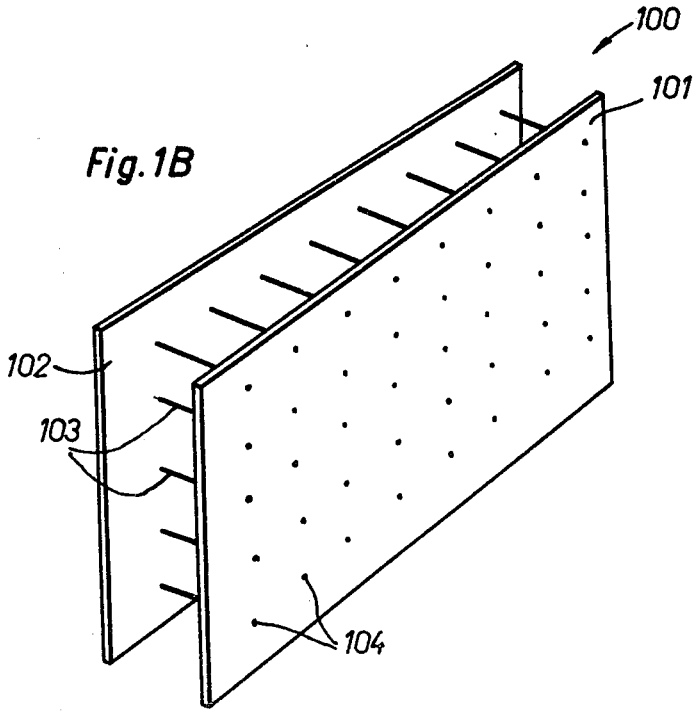
FIG. 1B is a perspective view of the general scheme of a biplanar stratiform metal-reinforcement for producing panels according to the invention.

FIG. 1B shows the diagram of a stratiform biplanar reinforcement structure 100 according to the invention. Two substantially coextensive and mutually distanced metal sheets 101, 102 are maintained in a substantially parallel and mutually supporting alignment by means of distancing or spacer elements 103. In practice, elements 103 will not normally be rod-like or pin-like structures but protrusions provided on one or both sheets 101, 102; preferred forms of protrusions will be explained below. It is to be noted, however, that elements 103 need not interconnect sheets 101, 102 such as by interwelding. In fact, it is preferred if one end only of each element 103 is connected with a sheet. Thus, all elements 103 might be connected with sheet 101 (as indicated by the dots on 101), while sheet 102 merely abuts upon the other ends. Alternatively, some elements 103 might be connected with sheet 101 and some other elements 103 might be connected with sheet 102.

Due to the use of the biplanar reinforcing structures according to the invention, the thickness of the mold compartments (i.e. the dimension that determines the panel thickness) in molding box 10 as well as a substantially parallel alignment of such compartments prior to casting, is maintained by the biplanar structures 17, 18 (with or without external distancing means).

This provides for several and substantial advantages:

(a) smooth cavity walls and hence less maintenance problems;

(b) panels of different predetermined thickness can be obtained even in one batch as the panel thickness will be defined by the biplanar metal-reinforcing structure (with or without external distancing means thereon) because reinforcing structures of different thickness may be used in a batch;

(c) the mold battery can be set up more conveniently merely by stacking the reinforcements with intermediate partitioning layers in the mold cavity, instead of first forming the mold compartments by mounting partitioning layers and subsequent insertion of the reinforcements into the compartments.

Generally, the length and width dimensions of the biplanar reinforcements will substantially correspond with the length and width dimensions of the panels produced.

Figure 2:
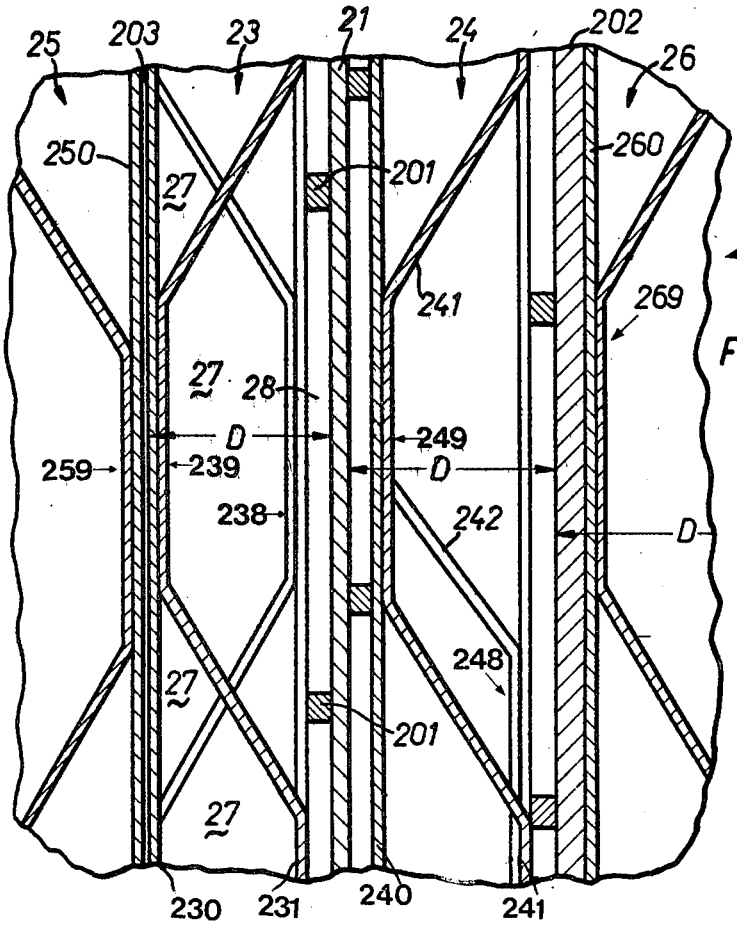
FIG. 2 is a diagrammatic sectional view of a portion of a stack in the molding box of FIG. 1A.

A horizontal sectional portion 19 (indicated in broken lines in FIG. 1A) of stack 11 is shown diagrammatically in an enlarged presentation in FIG. 2. While stacks of reinforcements and partitioning layers of the same kinds will be used in practice, a heterogeneous stack including different types of partitioning layers and reinforcements is shown in FIG. 2 for illustration.

Portion 19 of stack 11 includes one type of reinforcements 25, 26 consisting each of one plain metal sheet 250, 260 and a second metal sheet (base not shown) having a multiplicity of protrusions 259, 269 (only one is shown) that abut upon sheet 250, 260. Another type of reinforcements 23, 24 shown is formed of pairs of perforated metal sheets 230, 231; 240, 241, each having a multiplicity of protrusions 238, 239; 248, 249 (only one shown for each sheet) abutting upon the other sheet of the pair. As shown for reinforcement 23, the protrusions 238, 239 may be aligned for maximum mutual overlap, or—as shown for reinforcement 24—the protrusions 248, 249 may be in an off-set arrangement.

Partitioning layers of different types are shown in FIG. 2: A film 203 of a mold release agent, such as mineral oil, is between adjacent reinforcements 23, 25; such film could be a polymer sheet or film as well. A reusable molding board 21 is shown between adjacent reinforcements 24, 26 and a partitioning layer 202 in form of a preformed plate, e.g. made of an insulating material such as plaster, is shown between reinforcements 24, 26. Layer 202 will become integrated with the panel that is formed with reinforcement 26 upon casting and will have a mold release layer (not shown) on its surface turned towards reinforcement 24.

With reference to the reinforcements 23, 24 each is formed of two metal sheets 230, 231; 240, 241 of identical structure as explained below. When such sheets are put one onto the other with the protrusions pointing in the same direction (i.e. not for forming reinforcements), compact stacks of the perforated sheets can be formed and this is advantageous for convenient storage and transport. However, when arranging two metal sheets 230, 231; 240, 241 with the protrusions pointing towards each other as shown for reinforcements 23, 24, the first or base plane of one sheet of each reinforcement will be substantially contiguous with the second plane of the other sheet and an extremely well supported reinforcement with intermeshing protrusions for firmly anchoring the reinforcement in the matrix of the panel will result.

Generally, a substantially incompressible biplanar reinforcement is desirable that can withstand any compressive force normally encountered within a battery mold without laterally guided partitioning means; thus, a high compressive strength of the protrusions is desirable and the shape of the protrusions shown in FIG. 2 is well suited for this purpose.

The interspace 27 between sheets 230, 231 is an intercommunicating space that will be filled with matrixing material upon casting and communicates via the perforations with any interspace 28 between the outside of metal-reinforcement 23 and adjacent molding board 21 so that a coherent matrix can be formed upon casting.

As indicated above, interspaces 28 between the outer surfaces of the reinforcements and adjacent surfaces are optional and can be formed by means of distancing or spacer elements 201 inserted between the reinforcements and adjacent molding surfaces. As such distancing elements will be incorporated into the final panel, elements 201 preferably will consist of materials of low heat conductivity, e.g. of a ceramic material, concrete, plaster or the like, when a generally low heat conductivity is desired for the outer surfaces of the panels.

Further, as indicated for reinforcement 26 a preformed plate 202 of plaster or the like can be used at one or both outer surfaces of the reinforcement to provide for distancing from an adjacent surface; plate 202 thus is a partitioning layer also serving as a distancing element.

Figure 3:
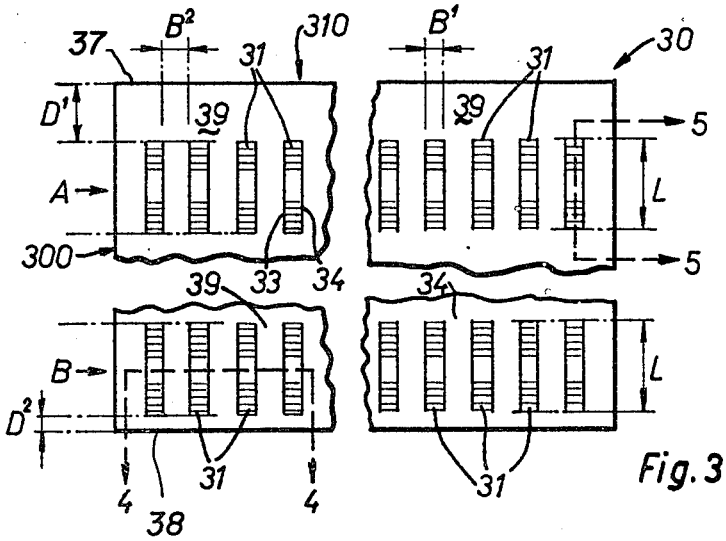
FIG. 3 is a diagrammatic and fragmented top view of a metal sheet suitable for pairwise assembly to form biplanar structures for use in the inventive method.

FIG. 3 is a diagrammatic, broken-apart top view of a metal sheet 30 for a biplanar reinforcement according to the invention resulting from assembling metal sheet pairs wherein at least one sheet has protrusions.

A multiplicity of elongated strip-type protrusions 31 is provided on sheet 30; the protrusions extend from the first or base plane 39 to a second or elevated plane distanced from plane 39 but parallel therewith. Each protrusion 31 has a longitudinal dimension L (length), a lateral dimension $B^1$ (width) and an elevational dimension $B_H$ (shown in the enlarged cross-sectional view of one protrusion in FIG. 5). The actual dimensions of the protrusion will depend upon such parameters as panel dimensions, type of matrixing material and desired degree of reinforcement. A main parameter is the thickness of the reinforcing metal structure which, typically, will be in the range of from about 20 mm to 300 mm or more with sheet gauges in the range of from about 0.5 mm to about 3 mm. The following minimum ratios assuming a given sheet thickness are presented for illustration:

| | |
|---|---|
| lateral dimension of protrusion ($B^1$) | thickness of sheet = 10:1 |
| elevational dimension of protrusion ($B_H$) | thickness of sheet = 15:1 |
| longitudinal dimension (L) of protrusion | thickness of sheet = 50:1 |

Figure 5:
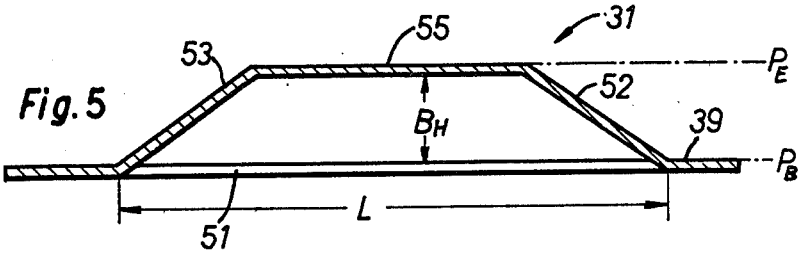
FIG. 5 is an enlarged sectional view of the metal sheet as shown in FIG. 3 along the line 5—5.

Any two adjacent protrusions 31 are separated by a distance $B^2$ that generally is at least as great as $B^1$. The protrusions 31 are formed each between two parallel cuts or slits 33, 34 in the sheet by pressing or deep-drawing of the sheet material of the strip to provide a shape such as shown in FIGS. 2 and 5 illustrating a preferred trapeze-type or bridge-shaped configuration that provides for high compressive strength of the protrusions. As shown in FIG. 5, a perforation 51 results when the protrusion is formed.

The protrusions 31 can be arranged in patterns or groups as shown in FIG. 3 by A, B and each group, or any protrusion, is distanced from the sheet edges 37, 38 by distances $D^1$, $D^2$. Of course, when the protrusions of groups A, B are in a different array, e.g. in an inclined, linear or curved pattern rather than in the linear vertical array shown, $D^1$, $D^2$ may be different for each protrusion. Preferably, $D^1$, $D^2$ is not smaller than about 1/10 of L. More than two arrays, or only one array with correspondingly smaller or larger L can be used. When using linear arrays with different $D^1$ and $D^2$ values, a pair assembled from such sheets will provide for off-setting of the intermeshed protrusions such as in reinforcement 24 in FIG. 2 when one sheet is turned in its plane.

In FIG. 3, the longitudinal dimensions L of the protrusions extend normally with respect to the side direction 310. Generally, when using elongated protrusions, it is preferred that the protrusion length L be substantially parallel with either direction 300 or 310 but an angular orientation of L versus 300 or L versus 310 could be used if intermeshing of the protrusions within the interspace between the sheets and mutual support of the unperforated portion of the one sheet by the protrusions of the other sheet, and vice-versa, is obtained in the biplanar reinforcement.

Use of perforated sheets is desirable for many purposes and may improve connection of the biplanar reinforcement with the matrix. Such perforations may be formed when forming protrusions, or separate therefrom. Generally, the degree of perforation of a sheet may be in the range of from 20 to 60% of the sheet surface; further, the metal sheets forming the biplanar structures may be made resistant against corrosion if required and/or pretreated by methods known for conventional metal reinforcement of concrete and the like matrixing materials.

A generally uniform distribution of the protrusions, or of the protrusion arrays, on the metal sheets may be desirable but is not believed to be critical. Asymmetric distribution may be suitable, e.g. such that pairwise assembly of identical sheets for mutual support by the protrusions can be effected with the sheets in registering alignment but with the protrusions in an off-set alignment.

When panels are to be produced according to the invention with metal sheets that are substantially smaller than the final panels, two or more sheets of the type described can be connected, e.g. by overlapping arrangement and interlocking of protrusions, to form extended sheets for both parts of the reinforcements.

Figure 4:
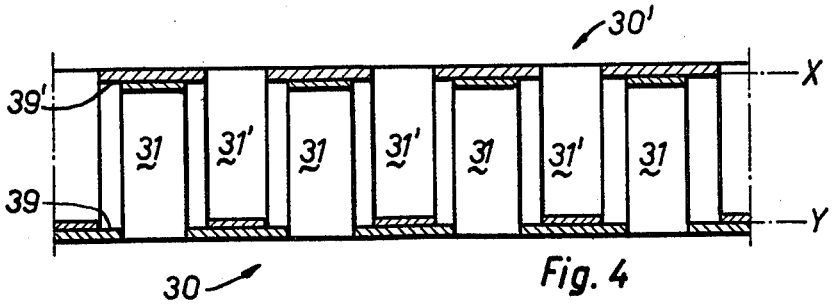
FIG. 4 is an enlarged sectional view of the metal sheet as shown in FIG. 3 along the line 4—4.

FIG. 4 is an enlarged cross-sectional view along the line 4—4 of FIG. 3 after two identical sheets 30, 30' have been assembled to form a biplanar structure according to the invention; dash-dotted lines X, Y indicate where each base of first plane 39, 39' of one sheet 30, 30' contacts each elevated or second plane of the other sheet 30', 30 in the biplanar structure formed by superimposing two identical sheets 30, 30' with their protrusions 31, 31' directed towards each other in an intermeshing arrangement. The sheet assembly of FIG. 4 is that of reinforcement structure 23 in FIG. 2. However, with an off-set intermeshing of protrusions such as in reinforcement structure 24, the mutual contact of planes in X, Y would be just the same.

FIG. 5 is an enlarged sectional side view of the shape of a protrusion 31 of FIG. 3. From the first or base plane $P_B$ defined by the unperforated part of the sheet, the two side parts 52, 53 of the strip that forms the protrusion 31 extend to the second or elevated plane $P_E$ defined by the most elevated central portion 55 of protrusion 31.

A substantially trapeze-shaped protrusion (when viewed in a plane that is parallel with the longitudinal extension and vertical to sheet base 39) is a preferred form of an integral as and continuous or bridging-type protrusion for use in the invention, both for reasons of high compressive strength and ease of manufacture (e.g. by a punch/draw-die). Such high compressive strength is due to the continuity of the sheet material from the base at one end through the elevation or bridge 52, 55, 53 as compared with open-ended protrusions such als L-shaped tongues, and to the inherent shape strength of a trapeze-shaped profile of the type shown in FIG. 5.

FIGS. 6A to 6D show, in diagrammatic cross-sectional views, preferred modes of stack arrangement, casting and panel discharge in the inventive method.

Figure 6A:
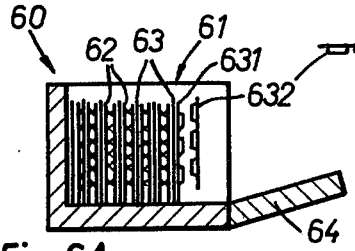
FIGS. 6A, 6B, 6C and 6D are diagrammatic cross-sectional views of a molding box during the main stages of a cycle of panel-forming according to the invention.

One side wall 64 of molding box 60 is opened in the position shown in FIG. 6A and stack 61 is formed by inserting biplanar reinforcements 62 and optional partitioning boards 63 in vertical position. The biplanar reinforcements may be formed by assembling two metal sheets 631, 632 within the mold cavity as indicated, or the sheets may be introduced in a preassembled form. When the stack is completed in FIG. 6A side wall 64 is closed.

Stack 61 will be closely packed and if a space of smaller thickness than the desired panel thickness remains it can be filled up with a board or the like. Because of such packing, no particular securing means are needed to keep the metal sheets in their operative position.

Figure 6B:
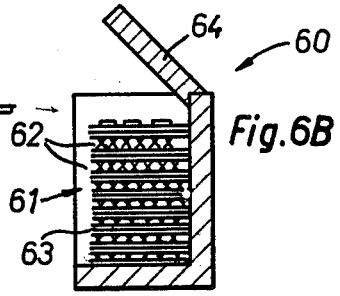

While stack 61 in FIG. 6A is formed with vertical layers, it may as well be formed in horizontally oriented manner as indicated in FIG. 6B where stack 61 is formed by stacking biplanar reinforcements 62 and optional molding boards 63 one onto the other into the molding box until stack 61 is completed. Again, side wall 64 is closed and pressed onto stack 61.

Figure 6C:
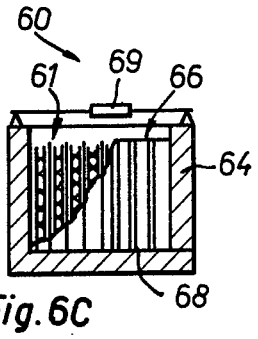

FIG. 6C shows molding box 60 in casting position. A pneumatically operated bracket or the like closing member 69 is used to press the side walls of the molding box 60 against stack 61. Concrete or the like matrix-forming material is cast as indicated at the right side of FIG. 6C so as to fill the mold compartments defined essentially by the biplanar structures in order to fill the voids within the biplanar structures as well as any interspaces between the biplanar structures and adjacent molding surfaces. A solidified stack 66 of metal-reinforced panels 68 is formed.

Suitable matrix-forming materials and additives, as well as casting methods, are well known in the art and will not be discussed herein in detail. Vibration of the matrix-forming material within the molding box is advantageous and conventional vibrators (not shown) may be attached to the molding box for that purpose.

As is known in battery-molding, heat developed upon hardening of the matrix may contribute to accelerate solidification and a matrix hardness sufficient for discharging the panels may be achieved within some hours after casting, e.g. in 5 to 20 hours. Additives that control heat release during solidification may be used; external heating means are not normally required.

Figure 6D:
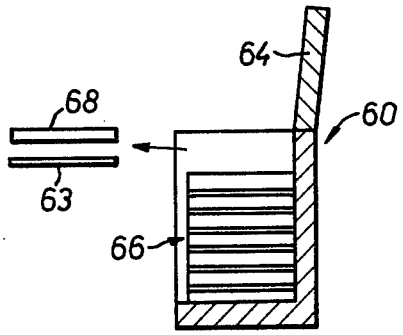

For discharging the panels from molding box 60 the latter is preferably tilted as shown in FIG. 6D so that the panels 68 may be withdrawn in lateral motion after side wall 64 is opened or removed. Panels 68 can be separated from stack 66 because of the partitioning layers which may, but need not, include re-usable molding boards 63.

The advantage of discharging the molding box in a position as shown in FIG. 6D is substantial because no particularly heavy lifting equipment is required and connection of the panels with lifting or other moving equipment is facilitated. Also, the danger of damaging the panels upon discharge from the molding box is reduced. Thus, use of a tiltable molding apparatus is generally preferred according to the invention and battery-molding devices that can be tilted by pivoting are known, e.g. from Belgian Pat. No. 564,974 mentioned above.

However, when considering production of metal-reinforced panels by battery-molding with panel dimensions of, say, $1.5\times15\times0.2$ meters and about ten panels per charge, the molding apparatus will have to support a charge weight in the order of 100 to 500 metric tons and such loads could be handled only with very heavy equipment that could not be moved without problems from one construction site to another.

As indicated above, use of so-called fluid-cushions or inflatable bags for tilting of the battery mold is suitable to avoid these problems as will be explained below and constitutes a second general aspect of the invention.

FIG. 7 shows, in a diagrammatic perspective view, a molding box 71 of the type explained above including a bottom wall 711, two front walls 712, 714 and two side walls 716, 718 for defining a cavity with the general shape of an open box. The cavity is suitable to receive a stack of biplanar reinforcements and partitioning layers for panel production as explained above.

A first fluid-cushion or inflatable bag 78 is arranged between bottom wall 711 of box 71 and a support surface 77, e.g. a bituminous or concrete top layer or, more simply, a planified area at or near a building site, if desired after some compaction with rollers and/or after application of temporary layers, such as mats.

A second fluid-cushion or inflatable bag 79 is arranged between one side wall 716 of box 71 and support surface 77. The force-transmitting external connection (not shown in FIG. 7) of box walls 711, 712 and bags 78, 79 can be effected by various means, e.g. belts or loops of a flexible band material, such as webbing, nets and other holding means, or by direct surface connections, such as adhesive, vulcanized, clamped or other interconnections of the box walls 711, 712 with optionally reinforced or rigidified adjacent wall portions of bags 78, 79.

Edge K of box 71 can be rounded off for direct contact with support face 77 when tilting, or a separate support (not shown) may be provided just below edge K to support the latter when tilting.

Bags 78, 79 may each consist of a single bag, a multi-compartment single bag, or of bag groups 780–783 and 790–793. Each bag or bag group is provided with conduits 74, 75 for connection with a source of fluid, such as a pump, an air-compressor, a container of pressurized fluids or the like, generally via valves or the like control means so as to provide for supplying or withdrawing of fluid (e.g. air or water) into and from each bag. The external volume of each bag is determined by the amount of fluid within such bag and such volume can be varied by means of fluid supplied to, or withdrawn from, the bags. If desired, conduits 74, 75 can be interconnected by a pump 751 so as to decrease the volume of one bag when the volume of the other bag is increased. Also, each bag 78, 79 or each bag group 780 or 790 respectively can be provided with separate inlet and outlet conduits for fluid supply and fluid withdrawal. Further, bags 78, 79 or bag groups 780–783 and 790–793, respectively can be arranged as separate cells of a common fluid-cushion.

When the volume of bag 78 or of bag group 780–783 is increased and the volume of bag 79 or of bag group 790–793 is decreased, or vice-versa, as explained in more detail below, box 71 will swivel or tilt in the directions of double arrow A-B. Swivelling (FIG. 7A) from the one end position into the other end position as shown will be called "tilting" without the intention to restrict tilting movement to the generally preferred tilt of about 90°.

Various tilting positions of box 71 of FIG. 7 are shown in the diagram of FIG. 7A: position F is the casting position; there, the one bag 78 or bag group 780–783 is emptied (volume $V_1$) to the extent that the bottom wall of box 71 is in a substantially horizontal position; in position F, bag 79 or bag group 790–793 may be filled but need not be filled, i.e. not yet filled or not filled anymore, and may thus have a filling volume between "zero" and "full".

In position F of box 71, concrete or the like matrixing material is poured into the cavity within box 71 with a stack of biplanar reinforcements and partitioning layers arranged therein as explained above, and the matrixing material is allowed to harden at least to the point where the panels can be withdrawn without damage.

Prior to discharging of the panels from molding box 71 the latter is tilted and the tilting movement is initiated by feeding fluid, such as water or air, under pressure into bag 78 so that its fluid volume increases from $V_1$ to $V_2$. A load that is supported by a single fluid-cushion without additional guidance may have a relatively unstable or "swimming" position; it is generally preferred to avoid such instability and this can be achieved in a convenient and simple manner, e.g. by providing that bag 78 in state F is not concentric with bottom wall 711 of box 71, and/or by using a bag with predetermined shape characteristics, e.g. a bag with a wedge-type shape when full, and/or by some guidance of box 71, e.g. by maintaining edge K of box 71 in contact with support surface 77 during the tilting movement. The same applies to bag 79 in state E at the start of the tilting-back movement.

When volume $V_1$ of bag 78 in state F (or volume $V_1$ of bag 79 in state E) is substantially zero, box 71 is in a stable position, but a small amount of fluid in bag 78 (or 79) when in state F (or E) may be advantageous, e.g. for compensating irregularities of support surface 77.

By increasing the volume of bag 78 from $V_1$ to $V_2$, box 71 will be lifted at its side remote from edge K until the center of gravity of box 71 is vertical above edge K and a metastable equilibrium position Z of box 71 is reached. At this moment, at the latest, second bag 79 or bag group 790–793 must be filled (volume $V_5$) to the extent required for supporting the adjacent side wall of box 71. Now, volume $V_2$ of the first bag can be decreased, maintained constant, or increased without this having a substantial effect upon the tilting operation; preferably, bag 78 is maintained to retain at least volume $V_2$ so that it will again support and carry bottom wall 711 when box 71 is tilted back from E through Z to F.

When using a liquid, such as water, as the fluid for filling bags 78, 79 it may be advantageous to feed any fluid withdrawn from one cushion into the other even though this is not required for support. Such alternating or reciprocating fluid displacement, i.e. when $V_1+V_6=V_2+V_5=V_3+V_4$, is termed "complementary" bag-filling and can be effected, for example, with a reversible pump as indicated in FIG. 7 by numeral 751.

At the transition from Z to E, i.e. from the metastable intermediate position into discharge position, bag 79 or bag group 790–793 having volume $V_5$ supports adjacent side walls of box 71; upon progressive decrease of volume $V_5$ to $V_4$, e.g. controlled by a discharge valve (not shown) in conduit 75, box 71 will be tilted continuously into discharge state E.

The panels within box 71 are now in horizontal position and can be removed easily from box 71 after lifting or removing the side wall 718*a* which is now on top of tilted box 71. Depending upon whether the stack for the next casting cycle is to be arranged in horizontal or vertical position, box 71 is tilted back from state E to F prior to or after forming the stack. However, subsequent casting will be effected with box 71 in state F.

As can be seen from FIG. 7A, this preferred embodiment of box 71 with two bags 78, 79 or two bag groups 780–783, 790–793 has the additional effect that the main load-bearing walls of box 71 will be externally supported, at least over a major or predominant surface portion of such walls, by the fluid-cushions or bags. This provides for substantial advantages, both for the molding box as well as for the tilting mechanism, because strength and stability requirements of the box can be substantially reduced; thus, molding boxes can be made according to conventional mechanical assembly techniques from relatively light units suitable for assembly at a construction site and disassembly for transport to another site; further, as assembly-type units can be used for the main walls of the molding box, the dimensions of the molding box can be changed when panel length and panel width are to be adapted to the requirements of a specific building. As the panel thickness is not determined by the molding box when using the inventive method, a substantial economic improvement of panel production by battery-molding can be achieved when using the novel method in conjunction with the novel apparatus.

As will be understood, the fluid-cushions used as tilting means of the battery-molding apparatus according to the invention do not present substantial problems of assembly or transport. Strength and stability requirements regarding the molding box can be substantially reduced as the walls and wall-connections of the molding box that bear the main load upon tilting can be externally supported by fluid-cushions in all tilting positions. Thus, commercial operation with molding box loads in the magnitude of several hundred metric tons is possible without extreme requirements for apparatus and operation: for example, when bags 78, 79 or bag groups 780–783, 790–793 are used for supporting and pivoting a molding box having a bottom wall of 2.5 m×15 m and side walls of 1.5 m×15 m to produce panels of 1.3 m×15 m×0.2 m, the weight of the charge within the molding box could be in the range of from about 200 to 400 metric tons, depending upon the specific weight of the concrete mix.

These loads will be distributed over the contacting surfaces of the bags that support the bottom wall and the one side wall, and the contacting surface area will be of the order of 20 to 40 $m^2$. Thus, an over-pressure of the fluid of only about 0.5 to about 3 $kg/cm^2$ is required for support, and tilting needs but a small increase, say about 10%, of the support pressure.

The preferred embodiment of the tiltable molding apparatus according to the invention explained above has one bag, or group of bags, on each side of edge K. As shown in FIG. 8, use of a single bag, or group of bags, would be sufficient for tilting a molding box when the latter, in its casting position, is in a metastable positional equilibrium. Molding box 81, in state F of FIG. 8, is in an upright or casting position maintained by a stop (symbolized by C) on one side, and by a fluid-cushion or bag 88 arranged between side wall 810 of box 81 and support surface 87, the bag being filled to maintain volume $V_9$. By reducing the bag volume from $V_9$ through $V_8$ to $V_7$, box 81 will be tilted into state E where the other side wall 812 is at the top and can be removed or lifted to position 812*a* for discharging panels formed in box 81. When bag 88 is filled with fluid to increase its volume from $V_7$ through $V_8$ to $V_9$, box 81 will return into casting position. As a more complicated structure of the molding box 81, e.g. a curved side wall, is required for the embodiment of FIG. 8, this embodiment is generally less preferred.

Fluid-cushions or bags of various construction are known per se and used, for example, for lifting heavy and relatively sensitive loads, such as aeroplanes; generally, such cushions are closed or cellular structures made of a flexible material that is substantially impermeable to the fluid and has the mechanical properties required to contain the fluid at an elevated pressure. For the purposes of the invention the fluid-cushion must be capable of changing its outer volume in response to a variation of the fluid contained therein but its wall need not be flexible throughout and may include non-flexible portions, e.g. at the area of contact with the molding box.

Gaseous or liquid fluids may be used, such as air and water, and selection of the fluid used may depend upon the location of use, i.e. whether water is in ample supply or not.

Fluid-cushions or bags for use according to the invention may have a regular or irregular shape and consist, at least in part, of a normally flexible material, e.g. a polymer composition (including elastomers and thermoplastics), e.g. polyolefin as well as synthetic or natural rubbers, preferably reinforced by flexible layers made of fibers or filaments, e.g. in the form of woven or non-woven materials, in order to increase tensile strength and tear resistance.

Stability under environmental conditions at a building site as well as for storage and transport is, of course, desirable and can be achieved with conventional sheet material compositions.

Fluid-cushions suitable for use herein are available commercially or may be manufactured from commercially available tube, sheet or web materials that can be made into closed bags by adhesive methods, welding, vulcanization, sewing or the like methods. Additional flexible layers for external support of the bags, such as nets, may be used if required for reinforcement or/and operative connection with the molding box.

From the foregoing description, one skilled in the art can easily ascertain the essential characteristics of this invention and, without departing from the spirit and scope thereof, can make various changes and modifications of the invention to adapt it to various usages and conditions.

While there are shown and described present preferred embodiments of the invention, it is to be distinctly understood that the invention is not limited thereto, but may be otherwise variously embodied and practiced within the scope of the following claims.

What I claim is:

1. In the method of producing a plurality of metal-reinforced panels in a molding box having a cavity defined by a bottom wall, two side walls and two front walls, in which method a number of reinforcing metal elements is arranged in said cavity with a partitioning means between any two adjacent elements, wherein said partitioning means having mold release properties, and wherein a flowable and hardenable material is fed into said cavity and is allowed to harden therein so as to form said metal-reinforced panels; said reinforcing metal elements each having a generally stratiform biplanar structure formed of at least two distanced metal sheets maintained in a substantially parallel and mutually supporting arrangement; the improvement comprising at least some of said partitioning means being molding boards in a laterally unguided connection with said walls, the distance between any two adjacent boards being determined essentially by said biplanar structures, and tilting said molding box by means of expandable fluid cushions.

2. The method of claim 1 wherein at least one of the said two metal sheets comprises a multiplicity of perforations and a multiplicity of protrusions of substantially uniform height extending from a first plane defined by said sheet in the unperforated parts thereof to a second plane distanced from but substantially parallel with said first plane, and wherein the other of said two metal sheets abuts said second plane.

3. The method of claim 2 wherein said reinforcing metal elements are formed by assembling pairs of said perforated metal sheets for contacting said first plane of each one sheet of said pairs with said second plane of each other sheet of said pairs.

4. The method of claim 1 wherein a stack of said reinforcing metal elements is arranged in said cavity with one partitioning means between any two adjacent metal elements to form a plurality of generally parallel mold compartments between said partitioning means and adjacent wall portions of said cavity.

5. The method of claim 2 wherein said protrusions are of substantially isomorphous shape, each protrusion being formed by a continuous strip of the metal of the sheet between two substantially parallel linear cuts therein and pressing a portion of said strip out of said first plane into said second plane.

6. The method of claim 5 wherein said protrusions are arranged on said sheet to form at least one group of substantially parallel and distanced protrusions having a longitudinal dimension and a lateral dimension, said group of protrusions extending sidewise to said longitudinal dimension of said protrusions and each two adjacent protrusions being separated by a distance that is at least as large as said lateral dimension.

7. The method of claim 2 wherein each of said protrusions has a longitudinal dimension and a generally trapeze-like shape when viewed in a sectional plane that is vertical to said first plane and parallel to said longitudinal dimension.

8. The method of claim 2 wherein at least about 20% and not more than about 60% of the total surface area of said perforated metal sheet is provided with openings formed in said first plane, and wherein the sheet material of each opening forms one of said protrusions.

9. The method of claim 1 wherein the molding box is part of a tiltable molding apparatus for producing a plurality of panels by casting a flowable and hardenable material into a plurality of compartments in a molding box of said apparatus provided with at least one fluid-cushion capable of varying its outer shape in response to varying the amount of fluid within said cushion, said cushion resting on a support surface and being connected with said molding box in a manner permitting a tilting movement of said molding box by variation of the amount of said fluid within said cushion.

10. The method of claim 1 wherein said partitioning means include preformed plates made of an insulating material and wherein said preformed plates are incorporated into said metal-reinforced panels.

11. The method of claim 1 wherein said partitioning means comprise a film of a material having mold release properties.

12. A method of producing metal-reinforced panels comprising the steps of:

forming a number of generally stratiform biplanar reinforcing elements by assembling pairs of spaced metal sheets in a substantially parallel and mutually supporting arrangement;

arranging said reinforcing elements in a molding box in a substantially horizontal stack with partitioning means between any two adjacent ones of said reinforcing elements and between interior surfaces of said molding box and reinforcing elements adjacent thereto, wherein at least some of said partitioning means are molding boards in a laterally unguided connection with the walls of the molding box, the distance between any two adjacent boards being determined essentially by said biplanar elements;

tilting said molding box until said reinforcing elements form a substantially vertical stack by means of at least one fluid-cushion capable of expanding and contracting;

pouring a flowable and hardenable material into said molding box to substantially fill said vertical stack;

allowing said material to harden and to form a stack of metal-reinforced panels; and separating said stack to obtain a number of metal-reinforced panels.

13. The method of claim 12, further including the step of:

tilting said molding box by means of at least one fluid-cushion capable of varying its outer shape in response to varying the amount of fluid within said cushion, said cushion resting on a support surface and being connected with said molding box in a manner permitting a tilting movement of said molding box by variation of the amount of said fluid within said cushion.

14. A tiltable molding apparatus suitable for producing a plurality of panels by casting a flowable and hardenable material, comprising:

a molding box having a bottom wall, two front walls and two side walls;

a plurality of compartments in said molding box of said apparatus;

two fluid-cushions capable of expanding and contracting in response to varying the amount of fluid within each said cushion;

said cushions resting on a support surface and being connected with said molding box in a manner permitting a tilting movement of said molding box by variation of the amount of said fluid within said cushions;

the first of said fluid-cushions being arranged between said support surface and said bottom wall while the second of said fluid-cushions being arranged between said support surface and one of said side walls;

said fluid-cushions being connected with conduit means for varying the amount of fluid in each cushion; and wherein said compartments are formed by partitioning means in a laterally unguided connection with the walls of the molding box.

15. The apparatus of claim 14 wherein said first fluid-cushion is in supporting contact with at least the predominant part of the outer surface of said bottom wall, and said second fluid-cushion is in supporting contact with at least the predominant part of the outer surface of said first side wall, said other side wall being provided for opening and closing said molding box.

16. The apparatus of claims 14 or 15 wherein said first fluid-cushion and said second fluid-cushion each consist of an interconnected group of cushions provided for simultaneously varying the amount of fluid within each interconnected group.

17. The apparatus of claim 14 wherein said walls are made of mountable and dismountable elements to facilitate transporting and change of box dimensions.

* * * * *